US012281548B2

(12) United States Patent
Prisbell et al.

(10) Patent No.: US 12,281,548 B2
(45) Date of Patent: Apr. 22, 2025

(54) WIRELESS SWITCH FOR PERFORATION TOOL

(71) Applicant: Schlumberger Technology Corporation, Sugar Land, TX (US)

(72) Inventors: Andrew Prisbell, Sugar Land, TX (US); Todd Busch, Alvin, TX (US); Atsushi Nakano, Rosharon, TX (US); Hari Prakash Kalakonda, Pune (IN); Steven Hernandez, Rosharon, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 151 days.

(21) Appl. No.: 18/042,824

(22) PCT Filed: Aug. 30, 2021

(86) PCT No.: PCT/US2021/048237
§ 371 (c)(1),
(2) Date: Feb. 24, 2023

(87) PCT Pub. No.: WO2022/047308
PCT Pub. Date: Mar. 3, 2022

(65) Prior Publication Data

US 2023/0349271 A1 Nov. 2, 2023

Related U.S. Application Data

(60) Provisional application No. 63/071,483, filed on Aug. 28, 2020.

(51) Int. Cl.
*E21B 43/1185* (2006.01)

(52) U.S. Cl.
CPC ..... *E21B 43/1185* (2013.01)

(58) Field of Classification Search
CPC ..... E21B 43/1185; F42D 1/045
USPC ..... 361/248
See application file for complete search history.

(56) References Cited

U.S. PATENT DOCUMENTS 3,611,270 A * 10/1971 Eppler ..... H01R 12/721 439/701
6,604,584 B2 8/2003 Lerche
7,505,244 B2 3/2009 Lerche
(Continued)

FOREIGN PATENT DOCUMENTS

KR 101847537 B1 4/2018
WO 2007118707 A3 4/2008
WO 2020163863 A4 9/2020

OTHER PUBLICATIONS

International Preliminary Report on Patentability issued in International Patent application PCT/US2021/048237 dated Mar. 9, 2023, 6 pages.

(Continued)

*Primary Examiner* — Thienvu V Tran
*Assistant Examiner* — Sreeya Sreevatsa
(74) *Attorney, Agent, or Firm* — Jeffrey D. Frantz

(57) ABSTRACT

A switch for a downhole tool features a circuit board having a plurality of push connectors and a container for enclosing the circuit board, the circuit board making electrical connection in the container by pushing the circuit board into the container, or by pushing electrical connectors into the container.

20 Claims, 5 Drawing Sheets

(56) References Cited

U.S. PATENT DOCUMENTS

| | | | | |
|---|---|---|---|---|
| 2008/0268718 | A1* | 10/2008 | Cox | H04Q 1/142 174/138 F |
| 2014/0033939 | A1 | 2/2014 | Priess | |
| 2014/0098480 | A1 | 4/2014 | Foster, Sr. | |
| 2014/0154892 | A1* | 6/2014 | Zantout | H01R 12/732 439/65 |
| 2014/0338552 | A1 | 11/2014 | Mace et al. | |
| 2020/0256168 | A1* | 8/2020 | Knight | E21B 43/119 |

OTHER PUBLICATIONS

International Search Report and Written Opinion issued in International Patent application PCT/US 2021/048237 on Oct. 28, 2021, 7 pages.

* cited by examiner

WIRELESS SWITCH FOR PERFORATION TOOL

CROSS REFERENCE PARAGRAPH

This application is a National Stage Entry of International Application No. PCT/US2021/048237, filed Aug. 30, 2021, which claims the benefit of U.S. Provisional Application No. 63/071,483, entitled "WIRELESS SWITCH FOR PERFORATION TOOL," filed Aug. 28, 2020, the disclosure of which is hereby incorporated herein by reference.

FIELD

Embodiments herein generally relate to electrical switches used in perforation tools for oil and gas prospecting. Specifically, the embodiments here related to wireless switches easily connectable to such tools.

BACKGROUND

Perforation tools are tools used in oil and gas production to form holes, passages, and/or fractures in hydrocarbon-bearing geologic formations to promote flow of hydrocarbons from the formation into the well for production. The tools generally have explosive charges shaped to project a jet of reaction products, including hot gases and molten metal, into the formation. The charges are activated by detonators, which are themselves typically activated by electronic signals. The detonators have wires that provide electric current to set off an explosive charge within the detonator.

Multiple perforation tools are typically used in one string to perforate a formation at many locations. In one often-used pattern, perforation tools are activated according to depth, with the lowest tool being activated first, and each tool in turn being activated after the next lower tool is activated. The activation pattern is moderated using electrical switches that provide current to detonators at the appointed time for each tool to be activated. Typically the wires of each detonator have to be soldered to a corresponding switch, and then the wires carrying power to the switch and connecting the switch to other circuitry and switches also have to be soldered to each switch. Typically, a total of five wires is soldered to each switch at the surface, and then each switch and detonator are installed in the tool before the tool is assembled and deployed. Two prior art documents illustrate some current designs of downhole switches. U.S. Pat. No. 6,604,584 describes control units for selectively activating devices in a downhole tool string. U.S. Pat. No. 7,505,244 describes various designs of microswitches that can be used to activate downhole tools.

The soldering takes time, making the process of assembling a tool slow and costly. Further, the soldered connections are vulnerable to disturbance by the shocks that accompany activation of the perforation tools downhole. Such disturbance can render one or all perforation tools in the string unusable after the entire string is assembled and deployed downhole. There is a need for better electrical switches for use in downhole perforation tools.

SUMMARY

Embodiments described herein provide a wireless switch for a downhole tool, comprising a circuit board having a plurality of push connectors; and a container for housing the circuit board.

Other embodiments described herein provide a component of a downhole tool, comprising a circuit board having a plurality of push connectors for receiving electrical connectors; and a container for the circuit board, the container having a receptacle for inserting the circuit board and connecting the circuit board with electrical connectors.

Other embodiments described herein provide a component of a downhole tool, comprising a housing with a receptacle; electrical connectors disposed in the receptacle; and a switch circuit board having a plurality of electrical connections that make electrical contact with the electrical connectors disposed in the receptacle when the circuit board is pushed into the receptacle.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The wireless switches described herein have electrical connection members that allow quick connection of wires to the switches without the need for soldering. The connection members are mostly push connections that allow electrical connection to a wire or other connector by pushing the wire into the connection member. Such push connectors allow for making quick electrical connection to the switch without the need for soldering or operating screw connectors. The switches can also have wire guides that constrain movement of the wires with respect to the connection members to reduce mechanical strain on the wires from movement of the switches.

Figure 1A:
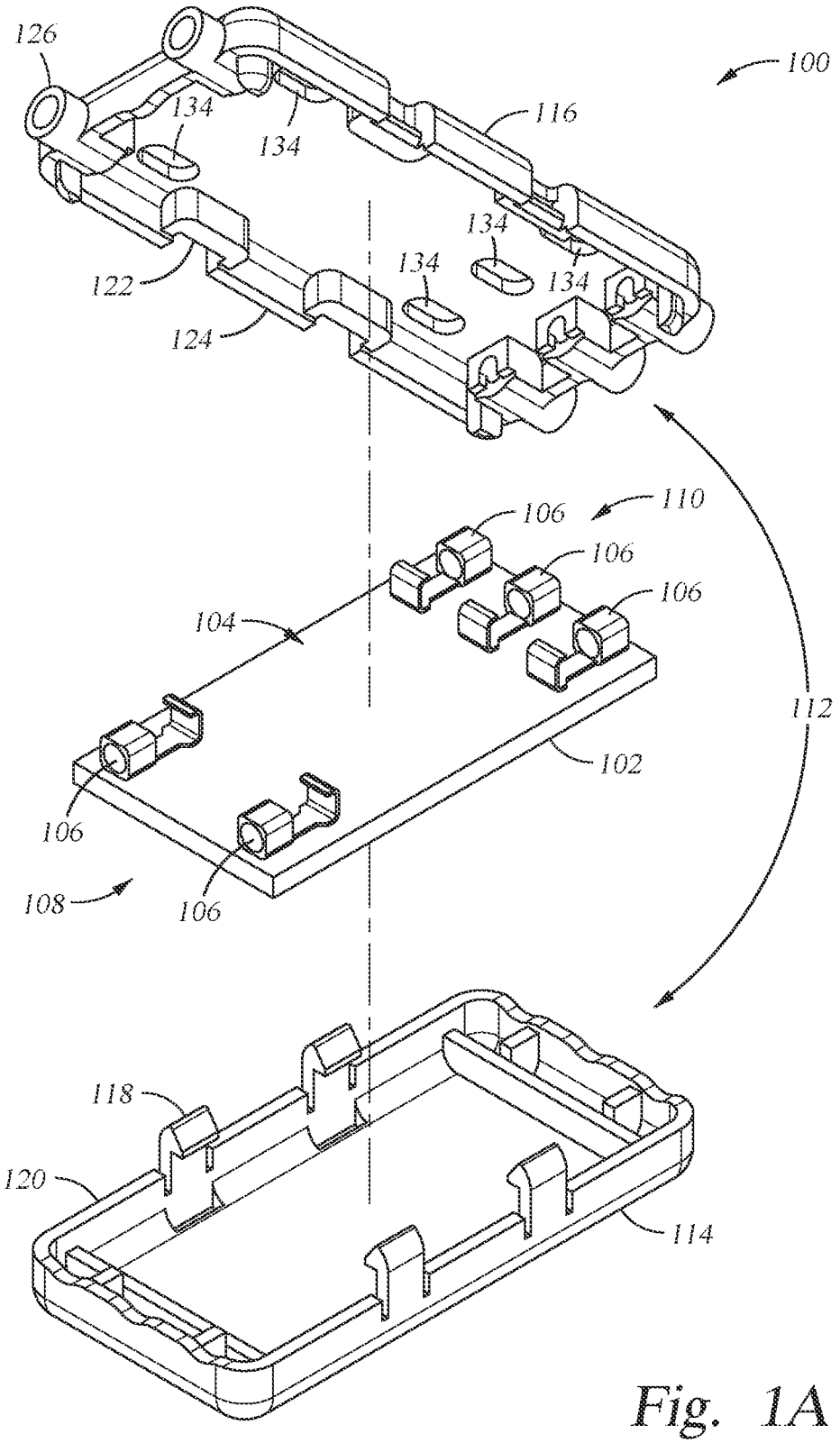
FIG. 1A is an exploded isometric view of a switch according to one embodiment.

FIG. 1A is an exploded isometric view of a wireless switch 100 according to one embodiment. The wireless switch 100 features a circuit board 102 with switch circuitry 104 and a plurality of push connectors 106 as connection members. The push connectors 106 are axial push connectors that make electrical contact with a wire by pushing the wire into the connector in a direction along the axis of the wire. In this case, there are two push connectors 106 at a first end 108 of the switch 100 and three push connectors at a second end 110 of the switch 100, opposite from the first end 108. Connection is made by inserting a stripped end of a wire into each push connector 106 and pushing the wire, in a direction along the axis of the wire, into the connector until the wire is securely held by the connector.

The circuit board 102 is housed in a container 112 that comprises a first member 114 and a second member 116. The container 112, in this case, has the general shape of a rectangular prism with rounded corners and edges. The first member 114 and second member 116 separate along a plane defined by the circuit board 102 to allow access to the circuit board 102 inside the container 112. The first member 114 has a plurality of prongs 118 around an edge 120 of the first member 114, and the second member 116 has a plurality of corresponding notches 122 around an edge 124 of the second member 116. Each prong 118 engages with a respective notch 122 to provide secure closure of the container 112. The first and second members 114 and 116 may be made of plastic, or any other structurally strong material. When made of plastic, the first and second members 114 and 116 may be molded or 3-D printed.

Figure 1B:
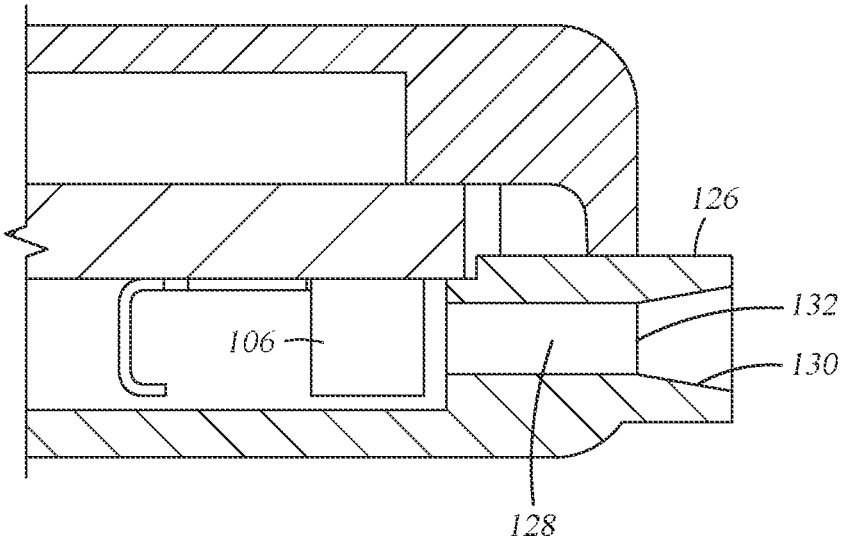
FIG. 1B is a cross-sectional view of a portion of the switch of FIG. 1A.

The switch 100 has wire guides 126 that constrain movement of wires inserted into the switch 100 to reduce the chance of disrupting the electrical connection between the wires and the switch 100. FIG. 1B is a cross-sectional view of a portion of the switch of FIG. 1A, showing one of the wire guides 126. Here, the wire guides 126 are conduits that penetrate the ends of the second member 116. Each push connector 106 has a corresponding wire guide 126 that extends through the wall of the container 112. Each wire guide 126 has a dimension across the wire guide 126 that varies along the length of the wire guide 126. In this version, each wire guide 126 has a first portion 128 and a second portion 130, the first portion 128 being between the second portion 130 and the corresponding push connector 106. The first portion 128 has a constant diameter slightly greater than an outer diameter of a wire to be inserted through the wire guide 126. The diameter of the first portion 128 is selected to allow the wire to move through the first portion 128 to make contact with the corresponding connector 106 while minimizing freedom of lateral movement for the wire once connected. The second portion 130 has a diameter that increases in a direction away from the first portion 128. That is, the second portion 130 has a diameter that is minimum at a junction location 132 where the second portion 130 meets the first portion 128, and that increases away from the junction location 132. Thus, the second portion 130 has a diameter that decreases toward the first portion 128. In some cases, the second portion 130 has a conical profile, which is to say the second portion 130, in some cases, has a linearly decreasing diameter. The decreasing diameter of the second portion 130 is selected and tailored to guide insertion of a wire into the wire guide 126. The wire is inserted into the wide end of the wire guide 126, and the decreasing diameter of the wire guide operates to guide the wire into the narrow second portion 130 of the wire guide, which in turn guides the wire to the corresponding push connector 106. The wire guides thus aid in guiding insertion of the wires for reliable electrical contact with the push connectors 106 and constrain lateral movement of the wires once connected.

Figure 1C:
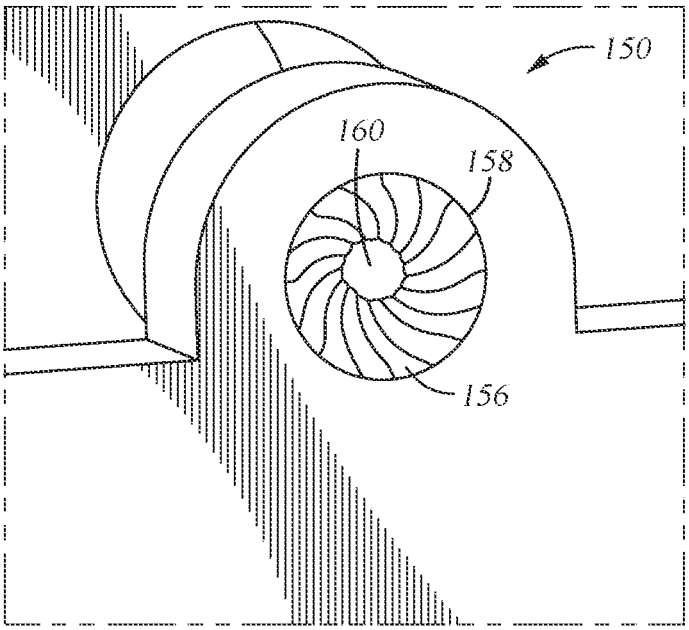
FIG. 1C is a cross-sectional view of a wire guide according to one embodiment.

The wire guides 126 are shown here as individual tubular members, but the wire guides 126 could have any suitable cross-sectional profile. For example, the wire guides 126 could have a square cross-sectional profile, or a cross-sectional profile that is square at one end and circular at the opposite end. The wire guides 126 may be formed integrally with the second member 116, as shown in FIG. 1, or may be formed integrally with the first member 114. Alternately, the wire guides 126 may be separate members that are positioned between the first and second members 114 and 116 at time of assembly, and after the container 112 is closed, become trapped between the first and second members 114 and 116. In one alternative, the three wire guides 126 adjacent to the second end 110 of the circuit board 102 may be connected to form a single wire guide member that is positioned between the first and second members 114 and 116, with a similar wire guide member positioned adjacent to the first end 108 of the circuit board. Such wire guides and wire guide members can be used with any compatible container type. For example, a heat-shrink container can be used with wire guides such as the wire guides 126, as separate members or integrated into wire guide members, along with the circuit board 102 and connectors 106. The wire guides can be aligned with the connectors, wrapped with shrink material, and processed to shrink the material and trap the wire guides in place. Suitable structures can be integrated into the circuit board 102 to position the wire guides for wrapping with shrink material, if desired.

The second member 116 has a plurality of viewports 134 formed in the major surface of the second member 116. The viewports 134 are positioned to provide view of the push connectors 106. When assembled, each viewport 134 is directly above a corresponding push connector 106. The viewports 134 aid in insertion of wires into the connectors 106 and inspection of the connection between the wires and the push connectors 106.

The wire guides can have internal structures to aid wire insertion or further constrain wire movement. FIG. 10 is a cross-sectional view of a wire guide 150 according to one embodiment. The wire guide 150 can be used with any of the switch embodiments described herein. The wire guide 150 can have a first portion and a second portion, much like the wire guides 126 of FIGS. 1A and 1B.

In this case, the wire guide 150 has internal structures 156 that extend from an inner wall 158 of the wire guide 150. Here, the internal structures 156 are vane-like members that extend from the internal wall 158 in an overlapping spiral pattern shaped like a mechanical iris. The internal structures 156 are made of a pliant material, such as rubber, at a thickness and stiffness to flex when a wire is pushed against the internal structures 156. The internal structures 156 flex to create a central opening 160 among the internal structures 156 for the wire to pass through. By operation of the pliant material, the central opening 160 can vary in size according to outer diameter of the wire being disposed through the wire guide 150, the pliant material flexing more or less to define a central opening 160 of requisite size. With the wire in place, the internal structures 156 apply centralizing force to the wire to prevent or minimize lateral movement of the wire. The internal structures 156 may also apply frictional force to the wire insulation to prevent or minimize axial and rotational movement of the wire in the wire guide 150.

Here, the internal structures 156 are shown disposed at the entrance of the wire guide 150, with each vane-like member attached to the inner wall 158 adjacent to the entrance of the wire guide 150. Thus, for wire guides such as the wire guides 126 having first portion 128 and second portion 130, internal structures configured as in FIG. 10 would be located in the second portion 130. Additionally, the vane-like members in FIG. 10 are arranged to define a substantially flat orifice member when in a relaxed state. In other embodiments, the internal structures 156 may be disposed at a different location within the wire guide 150, for example internal to the wire guide 150 and spaced apart from the entrance thereof. For wire guides such as the wire guide 126, the internal structures 156 shown in FIG. 10 may be located in the second portion 130 spaced apart from the entrance, that is between the entrance and the junction location 132, adjacent to the junction location 132 either in the second portion 130 or the first portion 128, in the first portion between the junction location 132 and the exit of the wire guide 126, or adjacent to the exit of the wire guide 126.

The internal structures themselves may also be configured differently in other embodiments. For example, the vane-like members may be pitched at different angles. Whereas, the vane-like members of the internal structure 156 of FIG. 10 are substantially parallel to a plane defined by the entrance of the wire guide 150 at the point where the internal structures are attached to the inner wall 158, the vane-like members can be pitched at any angle, with respect to the plane of the entrance, from 0 degrees to 90 degrees. The internal structures can also be configured to extend into the wire guide and along the length of the wire guide by any convenient length. The internal structures can be configured as fins internal to the wire guide, extending radially inward from the inner wall 158 and axially along the wire guide starting at any location in the first portion 128 or the second portion 130, in the wire guide 126, and ending at any location in the first portion 128 or the second portion 130. In other embodiments, the internal structures can extend radially inward from the inner wall 158 and extend along the length of the wire guide in a wavy pattern. In other embodiments, the internal structures can extend radially inward from the inner wall 158 and extend along the length of the wire guide in a helical pattern, which may be a screw-like single helix or an interwoven multi-helix.

Figure 2:
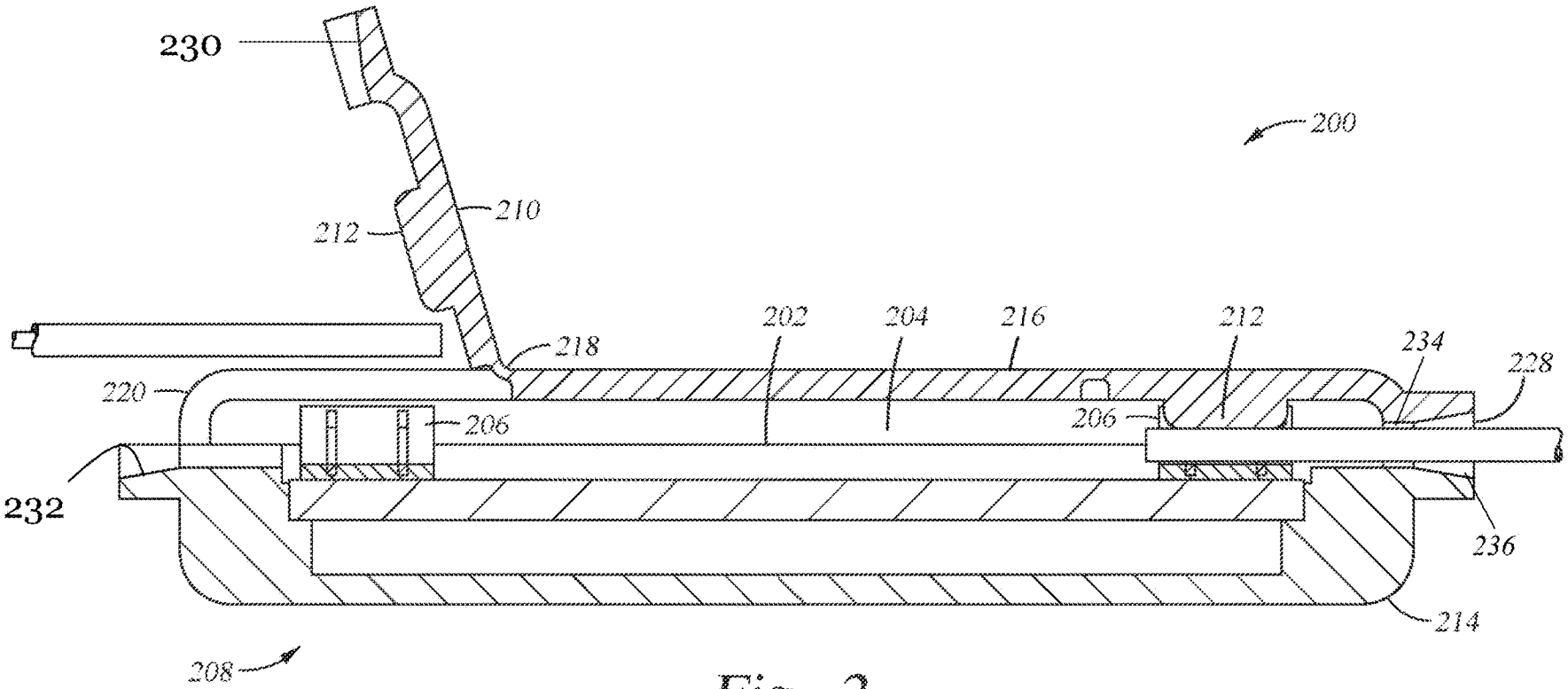
FIG. 2 is a schematic cross-sectional view of a switch according to another embodiment.

FIG. 2 is a cross-sectional view of a switch 200 according to another embodiment. The switch 200 has a circuit board 202 that has switch circuitry 204 along with a plurality of push connectors 206 as connection members. The push connectors 206 are radial push connectors. In this case, the push connectors 206 are positioned in the same locations as the push connectors 106 of FIG. 1. An example of a radial push connector is any of the wire-to-board connectors available from AVX Corp. of Fountain Inn, South Carolina. A wire is connected to each radial push connector 206 by positioning the wire against the push connector 206 and pushing the wire in a direction along a radius of the wire. Using the AVX connectors, the wires do not need to be stripped before connecting; the connector has blades that penetrate through insulation to contact the metal core of the wire.

Like the switch 100, the switch 200 has a container 208 that holds the circuit board 202. Each end of the container 208 has a hinged panel 210 that provides access to the push connectors 206. Each hinged panel 210 has a protrusion 212 that functions to push a wire into one of the push connectors 206. The container 208 has a first member 214 that provides a recess for receiving the circuit board 202 and a second member 216 that engages with the first member 214 to enclose the circuit board 202. The first and second members 214 and 216 may engage in the same way that the first and second members 114 and 116 of FIG. 1 engage.

The hinged panels 210 are formed as part of the second member 216, in this case. Each hinged panel 210 is connected to the rest of the second member 216 by a flexible portion 218. When closed, each hinged panel 210 is substantially aligned with the rest of the second member 216. When open, the hinged panel 210 projects upward and reveals an opening 220 through the second member 216 into the interior of the container 208. The opening 220 provides access to insert a wire into the container 208 to engage with the push connector 206. The wire is positioned atop the push connector 206. Each hinged panel 210 has a protrusion 212 that extends from an interior surface of the hinged panel 210 into the interior of the container 208 toward one or more of the push connectors 206. Each hinged panel 210 may have one protrusion 212 for all the push connectors 206 adjacent to the hinged panel 210, or each hinged panel 210 may have one protrusion 212 for each push connector 206. When a wire is positioned atop a push connector 206 with the hinged panel 210 open, the hinged panel 210 is then closed, and the protrusion 212 engages with the wire and pushes the wire in a direction along a radius of the wire to engage the wire with the push connector 206. The connector has blades that pierce the insulation of the wire and make contact with the metal core of the wire so the wire does not have to be stripped before connecting to the switch 200.

The switch 200 also features wire guides 228, in this case formed integrally with the first and second members 214 and 216. The wire guides 228 function in the same way as the wire guides 126 of FIG. 1. In the switch 200, the wire guides 228 are each cooperatively defined by the first and second members 214 and 216. The hinged panels 210 of the second member 216 have a plurality of scallops 230 formed at the end of each hinged panel 210. Each scallop 230 has a cylindrical profile of varying diameter with an axis extending in the longitudinal direction of the switch 200. The first member 214 has corresponding scallops 232 with cylindrical profiles that match that of the scallops 230. Together, the scallops 230 and the scallops 232 define the wire guides 228. As in the switch 100, the wire guides 228 have a first portion 234 that has a cylindrical profile with constant diameter and a second portion 236 that has cylindrical profile with increasing diameter, which can be a conical profile in some cases.

In FIG. 2, the hinged panels 210 are formed along the major surface of the container 208. In alternate embodiments, the hinged panels may form the ends of the container. In such cases, the hinged panels can be opened to provide access to the connectors through the ends of the container. Openings can be provided in the second member, as in FIG. 1, to allow access to the connectors to apply a tool for pushing the wires into the radial push connectors. Thus, a wire can be inserted through the end opening of the container to engage along the top of a connector and a tool can be deployed through the corresponding opening in the second member to push the wire into the connector. The hinged panel and the end of the first member can define wire guides similar to those shown in FIG. 2.

Figure 3:
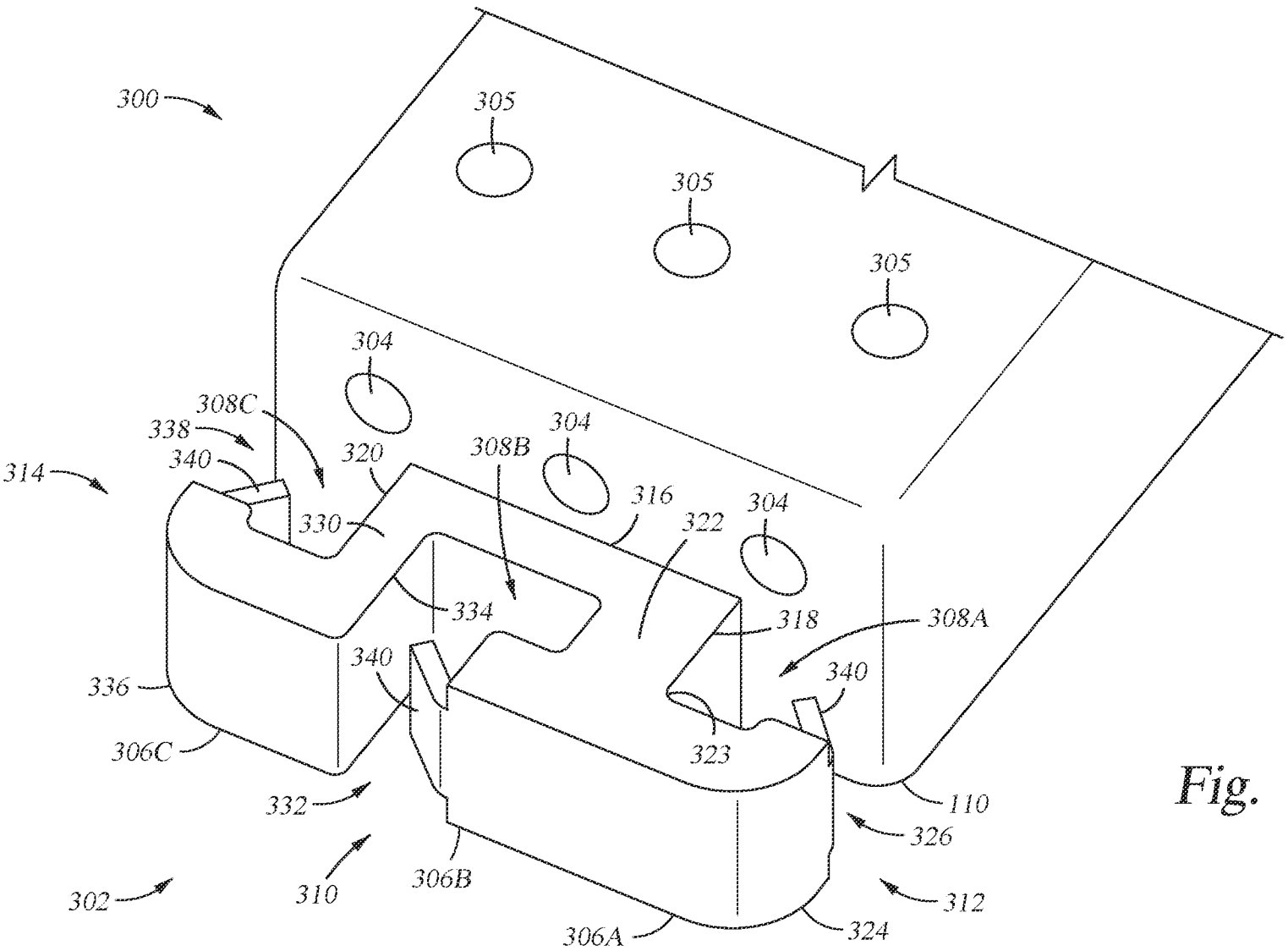
FIG. 3 is an isometric view of a switch according to another embodiment.

FIG. 3 is an isometric view of a wireless switch 300 according to another embodiment. The wireless switch 300 may be similar to the other wireless switches described herein, with the addition in FIG. 3 of a wire retention member 302 attached to the outside of the switch 300. The wire retention member 302 is attached at the second end 110 of the container of the switch 300, where three wires can be connected through openings 304 in the second end 110 of the switch 300. The wire retention member 302 has a plurality of prongs 306 (306A, 306B, and 306C), one for each wire to be inserted into an opening 304. Each prong 306 is located near a respective opening 304 and defines a retention area 308 (308A, 308B, and 308C) for restraining motion of the wire near the opening 304 to reduce the potential for mechanical stress and decoupling of the wire. FIG. 3 additionally shows openings 305 for receiving wire connectors in the top of the switch near the second end 110 as an alternative to having openings in the end of the switch 300. The description that follows is usable with the openings 304 in the end of the switch 300 or with the openings 305 in the top of the switch 300.

The particular shape and dimension of the features of the wire retention member 302 serve as an example of a wire retention member, but a wire retention member can have any convenient shape or configuration generally conforming to the description above. The example wire retention member 302 shown in FIG. 3 has a central region 310, a first peripheral region 312, and a second peripheral region 314. The central region 310 has an attachment portion 316 that is attached to the second end 110 of the switch 300. The attachment portion 316 extends along the second end 110 of the switch 300, with a first end 318 and a second end 320 opposite from the first end. A first flange 322 connects the first end 318 to the first peripheral region 312, extending outward from the first end 318 away from the second end 110 of the switch 300. The first peripheral region 312 includes a first prong 306A that extends away from the central region 310 and a second prong 306B that extends toward the central region 310. The first prong 306A is attached to an end 323 of the first flange 322 and extends away from the first flange 322. The first prong 306A has a curved tip 324 that curves toward the second end 110 of the switch 300 and forms a gap 326 between the tip 324 and the second end 110. The first prong 306A defines a first retention area 308A between the first prong 306A and the second end 110 of the switch 300. The gap 326 facilitates positioning a wire in the first retention area 308A, and has a dimension that is less than a dimension of the first retention area 308A to facilitate retention of a wire in the first retention area 308A.

A second flange 330 extends from the second end 320 of the attachment portion 316 outward and away from the second end 110 of the switch 300. The second flange 330 connects the second end 320 of the attachment portion 316 with the second peripheral region 314. The second prong 306B is attached to the end 323 of the first flange 322 and extends away from the first flange 322 toward the second flange 330. The second prong 306B forms a gap 332 between the second prong 306B and the second flange 330. The second prong 306B defines a second retention area 308B between the second prong 306B and the attachment portion 316, and a dimension of the gap 332 is less than a dimension of the second retention area 308B to facilitate retention of a wire in the second retention area 308B.

The second peripheral region 314 has a third prong 306C that is attached to an end 334 of the second flange 330 and extends away from the central region 310. The third prong 306C has a curved tip 336 that curves toward the second end 110 of the switch 300 forming a gap 338 between the tip 336 and the second end 110. The third prong 306C, along with the second end 110 of the switch 300, defines a third retention area 308C. The gap 338 has a dimension less than a dimension of the third retention area 308C to facilitate retaining a wire in the third retention area 308C.

Each of the first, second, and third prongs 306A, 306B, and 306C, has an end tab 340 that extends from the end of the respective prong. The end tab 340 extends from the curved tips 324 and 336 of the first and third prongs 306A and 306C. Each end tab 340 generally extends from its respective prong 306 toward the respective retention area 308 defined by the respective prong 306. Each end tab 340 serves as a catch to enhance retention of a wire in the respective retention area 308. The end tabs 340 may be flexible to facilitate installation and removal of wires from the retention areas 308.

As mentioned above, the structure shown in FIG. 3 is an example of a wire retention member, and any convenient structure that serves similar purposes can be used. For example, a similar wire retention member attached to the first end 108 of the switch 300 (not shown in FIG. 3) would have only two prongs matched to the two wire openings of the first end 108. Thus, such a wire retention member may be like the wire retention member 302 of FIG. 3 without the second (central) prong 306B. Dimensions and curvatures can be different, the end tabs 340 can be omitted, and other variations are possible.

Figure 4A:
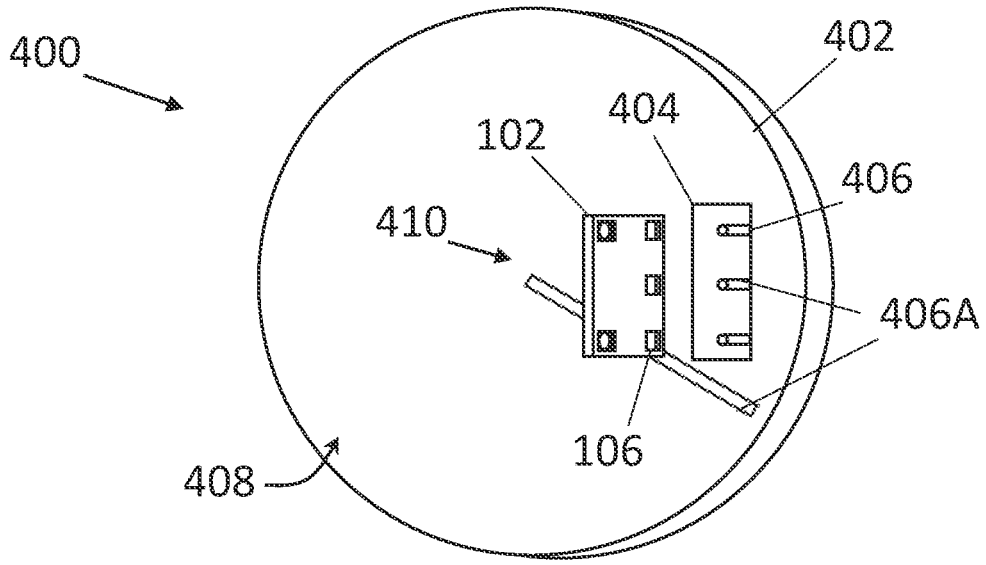
FIG. 4A is an end view of a perforation apparatus according to one embodiment.

FIG. 4A is an end view of a perforation apparatus 400 according to one embodiment. A housing 402 holds shaped charges (not shown; the shaped charges are installed in recesses in the side of the housing 402 not shown in FIGS. 4A and 4B). The housing 402 is cylindrical to fit within a tubular deployment structure. The housing 402, in this case, serves as a container for a switch circuit board. The housing 402 has a receptacle 404, in this case a slot, formed into the body of the housing 402 to receive the circuit board 102, shown in FIG. 4A positioned for insertion into the receptacle 404. Electrical connectors 406 are positioned within the receptacle 404 to connect with the electrical connection members 106 of the circuit board 102. The circuit board 102 is inserted into the receptacle 404 such that the electrical connection members 106 engage with and connect electrically to the electrical connectors 406. The electrical connectors 406 are rigid or semi-rigid electrically conductive members, for example brackets, that can withstand urging the electrical connection members 106 onto the electrical connector 406. One of the electrical connectors 406 is a downward connector 406A, for making electrical connection to tools further downhole, that passes from a first end 408 of the housing 402, near a center 410 thereof, around the side of the housing 402, through a peripheral portion of the body of the housing 402, to project into the receptacle 404 for connection with the circuit board 102.

Figure 4B:
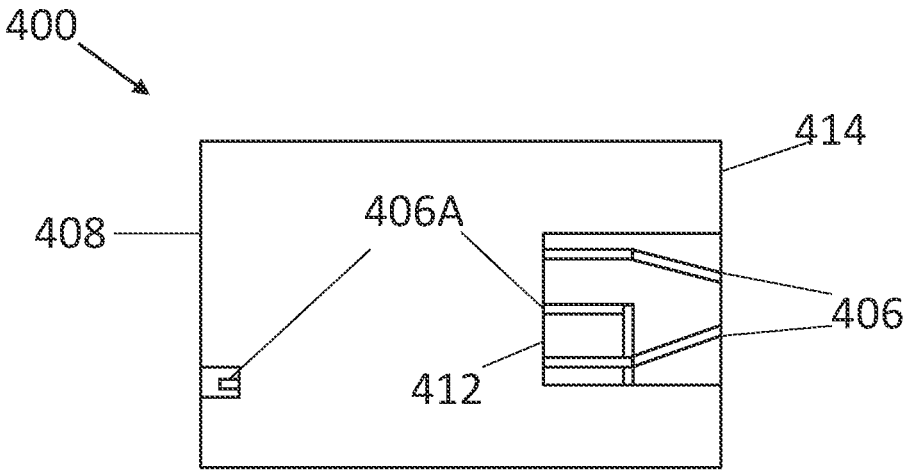
FIG. 4B is a side view of the perforation apparatus of FIG. 4A.

FIG. 4B is a side view of the perforation apparatus 400. The electrical connectors 406, for example brackets, are shown extended into an end 412 of the receptacle 404 for engagement with the circuit board 102 (not shown). Two of the electrical connectors 406 are routed toward a second end 414 of the housing 402 opposite from the first end 408. The downward connector 406A is routed through the body of the housing 402 to the first end 408. The electrical connectors 406 of the perforation apparatus 400 provide quick, easy connection of a circuit board having connections such as the electrical connection members 106 with the perforation apparatus 400, and with other tools in a tool string. In the embodiment of FIGS. 4A and 4B, the housing 402 of the perforation apparatus 400 is a container for the circuit board 102.

The perforation apparatus 400 illustrates one way electrical connectors can be built into the housing for the circuit board. In this case, the container is a frame for holding shaped charges. In other cases, the container may be incorporated into another component of a downhole tool, for example an initiation or detonation module or a pressure bulkhead module. In still other cases, a container may be provided for the circuit board that is not incorporated into another component of a downhole tool, but is, nonetheless, separate from the circuit board such that the circuit board is inserted into the container that is provided as part of the tool. This container may be located near another component, or even attached to another component, of the downhole tool. So long as the container has electrical connectors that can engage with electrical connections on the circuit board with a mere push, easy quick electrical connection is possible merely by inserting the circuit board into the container.

It should be noted that quick electrical connection between a circuit board and circuits of a perforation assembly can be made in other ways. For example, electrical connectors such as the connectors 406 can be used with a receptacle, such as the receptacle 404, that is configured to constrain a portion of the circuit board having electrical contact pads as push connectors to make contact with the connectors 406. The circuit board is pushed into the receptacle, and the structure of the receptacle pushes contact pads of the circuit board into contact with the connectors 406. In such cases, the push connector is a mixed axial/radial push connector because connection is made both by pushing the circuit board into the receptacle and by moving the circuit board in a radial direction with respect to the electrical connectors to make electrical contact. No box-type connection is needed to engage with the connectors 406 where the receptacle is shaped to push electrical pads on the circuit board into contact with the connectors 406. In other cases, pogo pin connections can be used as push connectors where pogo pins (or other spring-mounted connection components) are mounted on the circuit board, or onto the electrical connectors, such as the connectors 406, and a mating member for each of the pogo pins is attached to the other member, either the circuit board or the electrical connector.

The wireless switches of FIGS. 1A and 1B can be used with rigid electrical connectors, such as the brackets described in connection with FIGS. 4A and 4B. In other cases, a single electrical connection member can be provided on the circuit board for connecting with multiple electrical connectors. For example, a wire harness type connector can be used as an electrical connection member. Different types of electrical connection members can be used to connect one circuit board. For example, where multiple connectors are used, one or more of the connectors may be brackets and one or more of the connectors may be wires. Thus, for example, some connections to a circuit board may be made by pushing the circuit board into a container to make connection while other connections are made by pushing a wire, or rigid electrical connector, into an opening of the container to make electrical contact with electrical connection members on the circuit board. In such cases, different electrical connection members can be provided on the circuit board to accommodate the different styles of making electrical connection by pushing either the circuit board or the electrical connectors.

The wireless switches described herein provide quick and secure connection for wires to reduce tool assembly time in the field. Additionally, the wire guides of the wireless switches described herein provide motion constraint for connected wires to reduce the opportunity for disrupted connections due to motion of the switches. Lateral movement of the wires with respect to the connectors is constrained to virtually eliminate mechanical strain at the point of connection between the wires and the connectors.

While the foregoing is directed to embodiments of the present invention, other and further embodiments of the present disclosure may be devised without departing from the basic scope thereof, and the scope thereof is determined by the claims that follow.

What is claimed is:

1. A wireless switch for a downhole tool, comprising:

a circuit board having a plurality of push connectors; and a container for housing the circuit board, the container including a plurality of wire guides, each wire guide of the plurality of wire guides being disposed adjacent to a corresponding push connector of the plurality of push connectors and being sized and shaped to limit movement of a corresponding wire received in the wire guide.

2. The wireless switch of claim 1, wherein each wire guide of the plurality of wire guides includes a structure internal to the container, each of the structures extending from an inner surface of a corresponding wire guide of the plurality of wire guides, each of the structures being operable to constrain movement of the corresponding wire received in the corresponding wire guide of the plurality of wire guides.

3. The wireless switch of claim 2, wherein each of the structures includes a pliant material that flexes when contacted by the corresponding wire received in the corresponding wire guide of the plurality of wire guides.

4. The wireless switch of claim 2, wherein each of the structures includes flexible vanes arranged in an overlapping spiral pattern in the corresponding wire guide of the plurality of wire guides.

5. The wireless switch of claim 1, wherein each push connector of the plurality of push connectors is an axial push connector.

6. The wireless switch of claim 1, further comprising a wire retention feature attached to the outside of the container.

7. The wireless switch of claim 1, wherein the container comprises a plurality of electrical connectors for connecting with the plurality of push connectors of the circuit board.

8. The wireless switch of claim 1, wherein each push connector of the plurality of push connectors is a radial push connector.

9. The wireless switch of claim 8, further comprising a hinged panel operable to apply a radial force to the wires received in the plurality of wire guides.

10. A component of a downhole tool, comprising:

a circuit board having a plurality of push connectors for receiving wires; and a container for the circuit board, the container having a receptacle for inserting the circuit board and connecting the circuit board with electrical connectors disposed in the container, the container including a plurality of wire guides, each wire guide of the plurality of wire guides being disposed adjacent to a corresponding push connector of the plurality of push connectors and being sized and shaped to limit movement of a corresponding wire received in the corresponding push connector of the plurality of push connectors.

11. The component of claim 10, wherein the electrical connectors are brackets.

12. The component of claim 10, wherein electrical connection to the circuit board is made by pushing the circuit board into the receptacle.

13. The component of claim 10, wherein at least one of the electrical connectors is a rigid member disposed in the container.

14. The component of claim 10, wherein at least one of the plurality of push connectors is a box-type electrical connection member.

15. The component of claim 10, wherein the container is a frame for shaped charges.

16. The component of claim 15, wherein the receptacle is a slot, and the electrical connectors are rigid members disposed at an end of the slot.

17. The component of claim 10, wherein the electrical connectors are positioned in the receptacle.

18. A component of a downhole tool, comprising:

a housing with a receptacle, the housing including brackets disposed in the receptacle; and a switch circuit board having a plurality of electrical connection members, wherein the plurality of electrical connection members engages with and connects electrically with the brackets disposed in the receptacle when the switch circuit board is pushed into the receptacle.

19. The component of claim 18, wherein the component is a shaped charge module.

20. The component of claim 18, wherein the switch circuit board has a plurality of push connectors, and wherein the housing includes a plurality of wire guides, each wire guide of the plurality of wire guides being disposed adjacent to a corresponding push connector of the plurality of push connectors and being sized and shaped to limit movement of a corresponding wire received by the wire guide.

* * * * *